US005451342A

United States Patent [19]

Desai

[11] Patent Number: 5,451,342

[45] Date of Patent: Sep. 19, 1995

[54] WATERWHITE CLEAR LIQUID DETERGENT COMPOSITIONS

[75] Inventor: Sureshchandra G. Desai, Wayne, N.J.

[73] Assignee: Henkel Corporation, Plymouth Meeting, Pa.

[21] Appl. No.: 69,068

[22] Filed: May 28, 1993

[51] Int. Cl.[6] ..... C11D 1/12

[52] U.S. Cl. ..... 252/551; 252/532; 252/174.22; 252/DIG. 14

[58] Field of Search ..... 252/551, 108, 532, DIG. 14

[56] References Cited

U.S. PATENT DOCUMENTS

| | | | |
|---|---|---|---|
| 4,316,824 | 2/1982 | Pancheri | 252/551 |
| 4,595,526 | 6/1986 | Lai | 252/545 |
| 4,671,894 | 6/1987 | Lamb et al. | 252/545 |
| 5,244,593 | 9/1993 | Roselle et al. | 252/99 |

*Primary Examiner*—Paul Lieberman
*Assistant Examiner*—Necholus Ogden
*Attorney, Agent, or Firm*—Wayne C. Jaeschke; Norvell E. Wisdom, Jr.; Henry E. Millson, Jr.

[57] ABSTRACT

An aqueous waterwhite clear liquid detergent concentrate consisting essentially of A) at least one sodium, potassium or ammonium salt of a straight or branched chain $C_{10}$–$C_{18}$ alkylethoxy (1–3EO) sulfate;

B) at least one mono- or di-ethanolamide or isopropanolamide of a $C_{10}$–$C_{18}$ straight or branched chain saturated fatty acid; and C) from about 20 to about 90% by weight of water based on the weight of the concentrate; and wherein the weight ratio of component A to component B is in the range of from about 3:1 to about 20:1.

The invention also relates to diluted in-use solutions of the above concentrate, which are especially useful for hand dishwashing.

17 Claims, No Drawings

WATERWHITE CLEAR LIQUID DETERGENT COMPOSITIONS

BACKGROUND OF THE INVENTION

1. Field of the Invention

This invention relates to detergent compositions having particular utility for washing dishes by hand.

2. Statement of Related Art

U.S. Pat. No. 4,595,526 discloses a high foaming nonionic based, liquid detergent containing a major amount of a nonionic surfactant supplemented with lesser amounts of an anionic surfactant, a zwitterionic betaine surfactant, and a fatty acid alkanolamide foam stabilizer. The description of the anionic surfactant specifically excludes ethoxylated alkyl ether sulfates.

U.S. Pat. No. 4,316,824 discloses an aqueous liquid dishwashing detergent composition containing 10 to 50% of an anionic alkyl polyethoxylate sulfate surfactant in which the surfactant is at least partly in magnesium form, from 1 to 20% of a suds stabilizer which can be a monoethanol- or diethanol-amide of a $C_8$–$C_{18}$ fatty acid, and from 20 to 88% water. Also, most of the sulfate surfactant is in the form of an alkyl sulfate free from ethoxylate groups.

DESCRIPTION OF THE INVENTION

Other than in the operating examples, or where otherwise indicated, all numbers expressing quantities of ingredients or reaction conditions used herein are to be understood as modified in all instances by the term "about".

There have now been discovered clear waterwhite liquid detergent concentrates having particular utility in the form of a dilute aqueous solution as a hand dishwashing detergent. The detergent compositions of the invention contain the following essential components:

A) at least one sodium, potassium or ammonium salt of a straight or branched chain $C_{10}$–$C_{18}$ alkylethoxy (1–3EO) sulfate;

B) at least one mono- or di-ethanolamide or isopropanolamide of a $C_{10}$–$C_{18}$ straight or branched chain saturated fatty acid; and C) from 20 to 90%, preferably from 50 to 85% by weight of water based on the weight of the concentrate; and wherein the weight ratio of component A to component B is in the range of from 3:1 to 20:1, preferably from 4:1 to 15:1, and more preferably from 5:1 to 10:1. Of course, more dilute concentrates can be formed if desired, but they will be less desirable commercially. Also, concentrates containing relatively small quantities of water may require the presence of viscosity lowering agents in order to maintain the required liquid form.

Viscosity lowering agents are optional but preferred components, and are present in from 0.5 to 15%, preferably from 1 to 6%, and more preferably from 2 to 4% by weight, based on the weight of the concentrate. Such viscosity lowering agents include sodium or potassium xylene, cumene, or toluene sulfonate, propylene glycol, urea, ethanol, isopropyl alcohol, or mixtures of the above, with sodium xylene sulfonate and/or propylene glycol being preferred.

Other optional ingredients that can be present include from 0.1 to 10% by weight, based on the weight of components A plus B, of detergency builders, provided such builders do not adversely affect the clear, waterwhite nature of the concentrates. Water soluble citrates or tartrates such as sodium or potassium citrate or tartrate can be employed, as well as other builders that do not change the above characteristics of the concentrates of the invention.

Diluents can also be present as optional ingredients, e.g. inorganic salts such as sodium sulfate, ammonium chloride, magnesium chloride, sodium bicarbonite and the like.

It should be noted that no detergent components other than those given above are either needed or desired in the present compositions, and may in fact serve to eliminate or reduce one or more of the advantages of the compositions of the invention. These advantages will be discussed below in conjunction with the in-use solutions obtained from dilution of the above detergent concentrates.

With respect to component A), i.e. the sodium, potassium or ammonium salt of a straight or branched chain $C_{10}$–$C_{18}$ alkylethoxy (1–3EO) sulfate, the preferred sulfate is sodium laureth (2EO) sulfate. Other sulfates that can be used include sodium laureth (3EO) sulfate, sodium laureth (1EO) sulfate, potassium capryl (2EO) sulfate, ammonium myristyl (2EO) sulfate, sodium stearyl (3EO) sulfate, 2-methyllauryl (2EO) sulfate, and the like.

The mono- or di-ethanolamide or isopropanolamide of a $C_{10}$–$C_{18}$ straight or branched chain saturated fatty acid (component B above) is preferably lauryl myristyl monoethanolamide. Other examples of such alkylamides include coco monoethanolamide, coco diethanolamide, lauryl myristyl diethanolamide, lauryl myristyl monoisopropanolamide, lauryl monoethanolamide, and lauryl 2-methylmyristyl monoethanolamide.

The detergent concentrates of the invention are diluted with water for use as a hand dishwashing detergent solution. Dilute solutions containing from 0.01 to 1% by weight, based on anhydrous components, are effective for this purpose. From 0.02 to 0.5% by weight based on anhydrous components is preferred and produces excellent results.

The detergent concentrates and the dilute solutions of the invention possess a number of advantages. In addition to being clear and waterwhite, they possess excellent detersive activity at in-use concentrations against a wide range of food and other contaminants. They are completely biodegradable, economical, and have excellent skin compatibility at the in-use concentrations. Furthermore, they produce desirable levels of stable foam.

The invention will be illustrated but not limited by the following examples.

EXAMPLES

Example 1

A detergent composition was prepared by mixing together the following components at room temperature:

| % by weight | Component |
|---|---|
| 93.2 | 26% aqueous sodium laureth (2EO) sulfate |
| 6.8 | mixture of 40% lauryl myristyl monoethanolamide, 22–23% sodium xylene sulfonate, 35% water, and 2–3% inorganic salts |

The above detergent composition is a clear, water-white liquid having a viscosity of about 7,500 cps at 25° C.

Example 2

Various aqueous concentrations of the detergent composition of Example 1 were formulated and their soil emulsification capacity measured in comparison with a leading commercial product as a control.

The following food contaminant (soil) was prepared having the composition given below:

| Component | weight in grams |
|---|---|
| CRISCO ® short | 150.0 |
| Egg powder | 50.0 |
| tap water | 200.0 |
| Total | 400.0 g |

The above composition was prepared by warming a mixing bowl with tap water. The CRISCO ® and the egg powder were weighed and added to the warm bowl. The tap water was then added, and the mixture heated to 104° F. over a period of one minute while mixing at low speed. Blending was continued until the mixture attained a homogenous creamy consistency. 1×1.5 inch terry cloth swatches were soiled with the above mixture, using 1.0 g of mixture, expressed from a syringe, per swatch. Twenty swatches were used for each detergent solution. A Tergotometer TM was employed for testing each detergent solution. The Tergotometer was turned on and the bath heated to 120° F. Each Tergotometer bucket was filled with 355 ml of distilled water, 15 ml of detergent concentrate, and 30 ml of 2000 ppm concentrated hard water (calculated as $CaCO_3$). Agitation speed was adjusted to 75 rpm using a hand crank. Agitation was continued for 1 minute 45 seconds. One soiled swatch was added to each bucket and another soiled swatch added each 45 seconds thereafter with agitation until foam disappeared. The swatches were counted and the number of swatches was recorded as the grams of soil emulsified by the diluted detergent solution. An average value from two runs for each detergent concentrate used to form the diluted test solutions is given below in Table 1.

TABLE 1

| Detergent concentrate* | soil emulsified, g |
|---|---|
| CONTROL: Commercial clear hand dish-washing concentrate (34% active)** | 9.0 |
| Example 1 composition (26% active) | 8.75 |
| Example 1 composition (23.4% active) | 8.675 |
| Example 1 composition (20.8% active) | 8.125 |
| Example 1 composition (18.2% active) | 8.25 |
| Example 1 composition (15.6% active) | 7.25 |
| Example 1 composition (13.0% active) | 5.5 |

*The Example 1 compositions were diluted with water as necessary to obtain the above percentages of active ingredients in the detergent concentrates.
**Composition in accordance with U.S. Pat. No. 4,595,526.

It can be seen from Table 1 that the composition of Example 1 even when diluted to a concentrate having a 26% active ingredient level and tested by further dilution according to the procedure given above emulsified almost as much test soil as the control composition containing 34% active ingredients.

In addition, even when the Example 1 composition was diluted to a 15.6% active level, 7.25 g of test soil were emulsified compared to 9.0 g of soil for the control at an active ingredient level over twice as great.

Example 3

The detergent composition of Example 1 was modified by the addition of small quantities of propylene glycol, and viscosity determined. Also, the detergent composition of Example 1 was modified by the addition of further quantities of 40% active sodium xylene sulfonate. The quantities added, the viscosities obtained, and the cloud/clear points are given in Tables 2 and 3 below.

TABLE 2

| Product | % Additive Propylene Glycol | Viscosity, cps at 25° C. | Cloud/Clear Point |
|---|---|---|---|
| Ex. 1 (100%) | — | 7,600 cps | 58° F. |
| Ex. 1 (99%) | 1 | 4,950 cps | 58° F. |
| Ex. 1 (98%) | 2 | 3,500 cps | 58° F. |
| Ex. 1 (97%) | 3 | 2,400 cps | 58° F. |

TABLE 3

| Product | % Additive 40% Sodium Xylene Sulfonate | Viscosity, cps at 25° C. | Cloud/Clear Point |
|---|---|---|---|
| Ex. 1 (99%) | 1 | 4,350 cps | 59° F. |
| Ex. 1 (98%) | 2 | 2,860 cps | 58° F. |
| Ex. 1 (97%) | 3 | 1,080 cps | 58° F. |

What is claimed is:

1. An aqueous detergent concentrates consisting of

A) at least one sodium, potassium or ammonium salt of a straight or branched chain $C_{10}$–$C_{18}$ alkylethoxy (1–3EO) sulfate;

B) at least one mono- or di-ethanolamide or isopropanolamide of a $C_{10}$–$C_{18}$ straight or branched chain saturated fatty acid;

C) from about 20 to about 90% by weight of water based on the weight of the concentrate;

D) optionally, from about 0.5 to about 15% by weight, based on the weight of the concentrate, of a viscosity lower agent;

E) optionally, from about 0.1 to about 10% by weight, based on the weight of components A plus B, of a detergency builder; and F) optionally, an inorganic salt diluent;

wherein the weight ratio of component A to component B is in the range of from about 3:1 to about 20:1 and wherein the detergent concentrate is in the form of a clear waterwhite liquid and contains no detergents other than those set forth above.

2. The concentrate of claim 1 wherein from about 50 to about 85% by weight of water is present therein.

3. The concentrate of claim 1 wherein the weight ratio of component A to component B is from about 4:1 to about 15:1.

4. The concentrate of claim 3 wherein said weight ratio is from about 5:1 to about 10:1.

5. The concentrate of claim 1 which contains a viscosity lowering agent.

6. The concentrate of claim 5 wherein from about 1 to about 6% by weight of viscosity lowering agent is present therein.

7. The concentrate of claim 6 wherein the viscosity lowering agent is one or more of sodium or potassium xylene, cumene, or toluene sulfonate, propylene glycol, urea, ethanol, or isopropyl alcohol.

8. The concentrate of claim 7 wherein the viscosity lowering agent is one or both of sodium xylene sulfonate and propylene glycol.

9. The concentrate of claim 1 wherein component A) is sodium laureth (2EO) sulfate.

10. The concentrate of claim 1 wherein component B) is lauryl myristyl monoethanolamide.

11. The concentrate of claim 1 wherein component A is sodium laureth (2EO) sulfate and component B is lauryl myristyl monoethanolamide.

12. The concentrate of claim 1 wherein from about 50 to about 85% by weight of water is present therein; the weight ratio of component A to component B is from about 4:1 to about 15:1; and a viscosity lowering agent is present therein.

13. The concentrate of claim 12 wherein the weight ratio of component A to component B is from about 5:1 to about 10:1; and from about 1 to about 6% by weight of viscosity lowering agent is present therein.

14. The concentrate of claim 12 wherein the viscosity lowering agent is one or more of sodium or potassium xylene, cumene, or toluene sulfonate; propylene glycol; urea; ethanol; or isopropyl alcohol; component A) is sodium laureth (2EO) sulfate and component B is lauryl myristyl monoethanolamide.

15. A dilute aqueous detergent solution containing from about 0.01 to about 1% by weight of components A plus B of claim 1.

16. The dilute solution of claim 15 wherein from about 0.02 to about 0.5% by weight of components A plus B are present therein.

17. A dilute aqueous detergent solution containing from about 0.01 to about 1% by weight, based on anhydrous components, of the concentrate of claim 5.

* * * * *

UNITED STATES PATENT AND TRADEMARK OFFICE

CERTIFICATE OF CORRECTION

PATENT NO. : 5,451,342

DATED : September 16, 1995

INVENTOR(S) : Sureshchandra G. Desai

It is certified that error appears in the above-indentified patent and that said Letters Patent is hereby corrected as shown below:

In col. 2, line 7, delete [sodium bicarbonite] and insert --sodium chloride--.

Signed and Sealed this

Third Day of September, 1996

*Attest:*

Bruce Lehman

BRUCE LEHMAN

*Attesting Officer*

*Commissioner of Patents and Trademarks*